US007000693B2

(12) United States Patent
Powell

(10) Patent No.: US 7,000,693 B2
(45) Date of Patent: Feb. 21, 2006

(54) CONTROL OF HYDROCARBON WELLS

(75) Inventor: Steven Robert Powell, Bristol (GB)

(73) Assignee: Vetco Gray Controls Limited, Bristol (GB)

( * ) Notice: Subject to any disclaimer, the term of this patent is extended or adjusted under 35 U.S.C. 154(b) by 186 days.

(21) Appl. No.: 10/408,803

(22) Filed: Apr. 7, 2003

(65) Prior Publication Data

US 2003/0196790 A1 Oct. 23, 2003

(30) Foreign Application Priority Data

Apr. 17, 2002 (GB) ..... 0208800

(51) Int. Cl.
*E21B 4/00* (2006.01)
*E21B 43/01* (2006.01)
*G01V 3/00* (2006.01)

(52) U.S. Cl. ..... 166/66.4; 166/66.6; 166/113; 166/243; 166/368; 340/853.3; 340/855.3

(58) Field of Classification Search ..... 166/381, 166/373, 65.1, 66, 66.4, 66.6, 75.11, 369, 166/52, 86.1, 88.1, 113, 243, 335, 368, 363; 340/853.3, 855.3
See application file for complete search history.

(56) References Cited

U.S. PATENT DOCUMENTS 3,219,107 A * 11/1965 Brown, Jr. et al. ..... 166/250.15
3,633,667 A * 1/1972 Falkner, Jr. ..... 166/366
3,863,714 A * 2/1975 Watson, Jr. ..... 166/53
4,102,394 A * 7/1978 Botts ..... 166/66
4,112,687 A * 9/1978 Dixon ..... 60/641.6
4,174,000 A * 11/1979 Milberger ..... 166/363
4,284,943 A * 8/1981 Rowe ..... 318/806
4,289,996 A 9/1981 Barnes et al.
4,304,989 A * 12/1981 Vos et al. ..... 377/2
4,337,829 A * 7/1982 Banzoli et al. ..... 166/366
4,526,228 A * 7/1985 Wynn ..... 166/53
4,687,054 A * 8/1987 Russell et al. ..... 166/66.4
5,146,991 A * 9/1992 Rogers, Jr. ..... 166/369
RE34,111 E * 10/1992 Wynn ..... 166/53
5,736,793 A 4/1998 Jahrsetz et al.
6,119,781 A * 9/2000 Lemetayer et al. ..... 166/369
6,149,683 A 11/2000 Lancisi et al.
6,247,536 B1 * 6/2001 Leismer et al. ..... 166/305.1
6,257,549 B1 * 7/2001 Hopper ..... 251/129.11
6,315,523 B1 * 11/2001 Mills ..... 417/45
6,420,976 B1 * 7/2002 Baggs et al. ..... 340/853.3
6,536,522 B1 * 3/2003 Birckhead et al. ..... 166/250.15
6,599,095 B1 * 7/2003 Takada et al. ..... 417/53
2002/0007952 A1 * 1/2002 Vann ..... 166/369
2002/0112860 A1 * 8/2002 McDaniel ..... 166/381
2003/0196790 A1 * 10/2003 Powell ..... 166/65.1
2004/0159430 A1 * 8/2004 Baggs ..... 166/250.15

FOREIGN PATENT DOCUMENTS

EP 984133 A1 * 3/2000

(Continued)

*Primary Examiner*—Jennifer H Gay
(74) *Attorney, Agent, or Firm*—Bracewell & Giuliani LLP

(57) ABSTRACT

An apparatus controls the operation of a hydrocarbon production well. The apparatus includes a supply means for providing an electric power supply. The apparatus also includes a plurality of electrically operated actuating devices. The actuating devices can be a plurality of electric motors. The apparatus includes drivers responsive to the power supply for providing a drive signal for the actuating devices. The apparatus also includes a control assembly for applying the drive signal to the actuating devices in a multiplexed manner. The power from each driver creates a power input signal. When there are more than one input signals, they are multiplexed so that a single signal is received by the actuating devices.

8 Claims, 2 Drawing Sheets

FOREIGN PATENT DOCUMENTS

| | | |
|---|---|---|
| GB | 2 328 492 A | 2/1999 |
| GB | 2 332 220 A | 6/1999 |
| GB | 2 350 659 A | 12/2000 |
| GB | 2 382 600 A | 6/2003 |
| SU | 1698876 | 12/1991 |
| WO | WO 97/09773 | 3/1997 |

* cited by examiner

CONTROL OF HYDROCARBON WELLS

CROSS REFERENCE TO RELATED APPLICATION

This application claims the benefit of United Kingdom patent application 0208800.3, filed Apr. 17, 2002.

FIELD OF THE INVENTION

The present invention relates to the control of hydrocarbon wells.

BACKGROUND OF THE INVENTION

Traditionally, fluid production systems on subsea hydrocarbon wells have been powered by hydraulics fed from a high-pressure source on a surface vessel or platform via expensive umbilical tubing. The historical reason for this is that hydraulic systems were seen to be very reliable compared to electrical systems, mainly because the required electric devices, both actuating and control, such as motors and relays, were considered to be much less reliable than hydraulic equivalents.

However, with recent developments in electric motors and electrically powered actuators for the subsea environment and the maturity of solid state power switching devices, such as solid state relays, the simplicity of electrical systems is becoming attractive to the subsea fluid extraction business, both from the point of view of costs and reliability.

The use of electrically powered techniques in subsea fluid extraction is disclosed, for example, in GB-A-2 328 492, GB-A-2 332 220 and GB-A-2 350 659 and UK Patent Applications Nos. 0128924.8 and 0131115.8.

SUMMARY OF THE INVENTION

According to the present invention, there is provided apparatus for use in controlling the operation of a hydrocarbon production well, comprising:

supply means for providing an electric power supply, a plurality of electrically operated actuating devices;

drive means responsive to said power supply for providing a drive signal for said devices; and control means for applying said drive signal to said actuating devices in a multiplexed manner.

Said supply means may comprise an umbilical electric cable.

Said power, supply may be AC, for example 3-phase AC.

Said actuating devices could be electric motors.

The apparatus preferably includes further such drive means, the control means being adapted to select whether to apply the drive signal of the further drive means to said actuating devices in a multiplexed manner or the drive signal from the first-mentioned drive means to said actuating devices in a multiplexed manner.

In this case said control means could cause the drive signal of the other of the drive means instead of that of the selected drive means to be applied to said actuating devices in a multiplexed manner in the event of a fault.

Said control means could include means for monitoring said power supply.

Said control means could monitor the or each drive means.

The present invention also comprises apparatus according to the invention, at a well tree of a hydrocarbon production well.

BRIEF DESCRIPTION OF THE DRAWING

The present invention will now be described, by way of example, with reference to the accompanying drawings, in which.

DETAILED DESCRIPTION OF THE INVENTION

Figure 1:
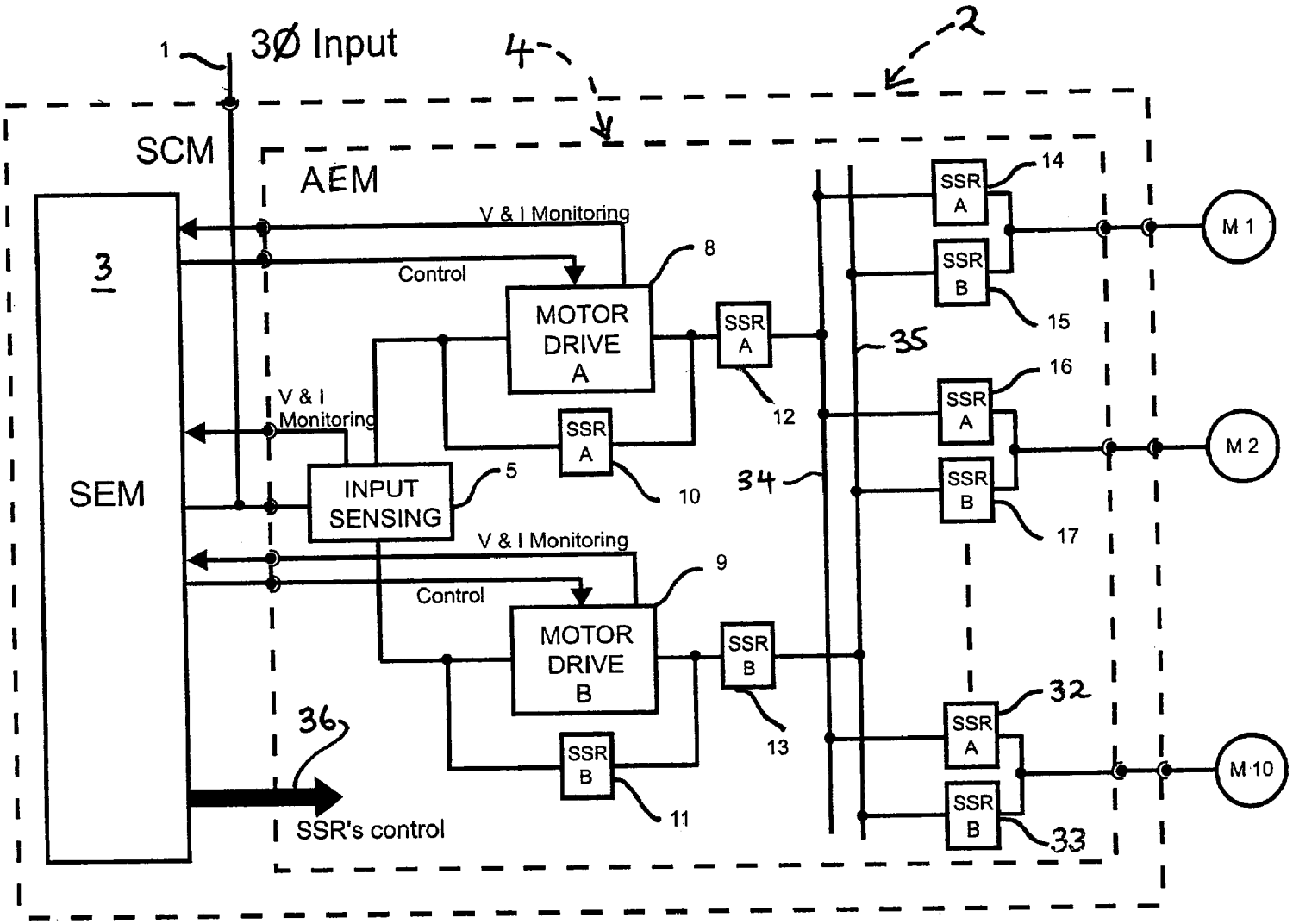
FIG. 1 is a block diagram of an example of the invention, being a system for distributing and controlling the use of three-phase electric power at a subsea hydrocarbon production well.

Referring first to FIG. 1, three-phase (3.ø), fixed frequency AC electric power is supplied to the apparatus via a supply line 1, typically an electric umbilical cable, from a platform or vessel to a subsea control module (SCM) 2 of the apparatus, mounted on a well tree. The SCM 2 houses a subsea electronics module (SEM) 3 and an actuator electronic module (AEM) 4. The input AC power feeds via a connector through the SCM 2 to the SEM 3, to provide basic low voltage supplies for the electronic circuitry of the apparatus, and to an input sensing unit 5 in the AEM 4.

Figure 2:
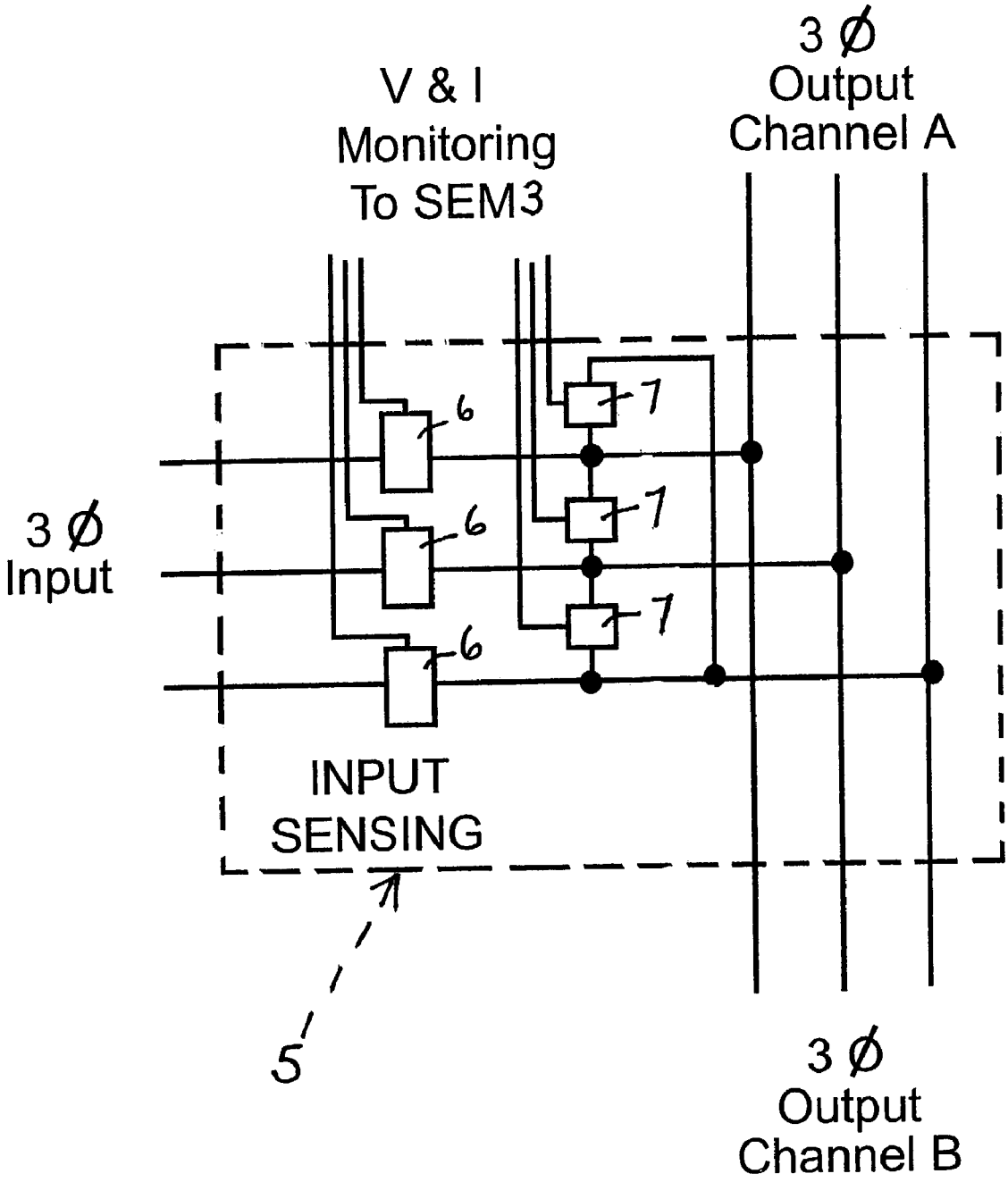
FIG. 2 is a block diagram of a sensing unit of the system.

FIG. 2 shows the unit 5 which contains devices 6 to sense voltage (V) in respective ones of the three input phases and devices 7 to sense current (I) in respective ones of the three input phases, to enable measurement of these parameters, which are required by logic circuitry installed in electronic circuitry housed in the SEM 3, outputs of devices 6 and 7 being connected to the SEM 3 for that purpose. The input sensing unit 5 has dual outputs (channels A and B) feeding motor drive units 8 and 9 respectively. Since only one motor drive unit is in operation at a time, the other motor drive unit provides 100% redundancy in the event of a fault.

The motor drive units 8 and 9 are high power electronic inverter units, each of which provides both a variable voltage and a variable frequency output under the control o f the SEM 3. The output voltage and current of each of motor drive units 8 and 9 (i.e. the voltage (V) applied to and the current (I) taken by the motor connected to the system at the time) are also sensed and fed back to the SEM 3 to enable measurement of these parameters for use by the logic circuitry in the SEM 3.

Further redundancy is provided in an emergency if both motor drive units were to fail, by by-passing them with high power, solid state relays (SSR's) 10 and 11.

The output of a chosen one of motor drive unit 8 (channel A) and motor drive unit 9 (channel B) is available to drive devices on the well tree which, in the example illustrated, are three-phase electric motors M1 to M 10. The channel selection is effected by the SEM 3, which switches on via an output 36 the appropriate one of SSR 12 (for channel A) or SSR 13 (for channel B), thus providing power to a power distribution rail 34 (feeding motor selection SSR's 14, 16–32) or a distribution rail 35 (feeding motor selection SSR's 15, 17–33).

The logic circuitry in SEM 3 decides selection of the motor drive channel A or B. Initially, channel A is selected with SSR 12 switched on and SSR 13 off. The operational requirements of the well are fed to the SEM 3, such as which motor is to be operated and in which direction, the operation of the motors being multiplexed by control of the SSR's 14, 16–32 via output 36. The start-up of each motor is achieved by the motor drive unit 8 outputting a low frequency, low voltage output, initially, which increases in frequency and voltage as the motor speeds up. The characteristics of each motor start requirement are stored in a memory of the SEM 3. During the operation of each motor, the logic circuitry in the SEM 3 uses the monitored motor drive unit output current and voltage information (i.e. the motor demand) from motor drive unit 8 with the input current and voltage information monitored by the input sensing unit 5 and, taking into account the quiescent power requirements of the motor drive unit, assesses whether there is a fault in either the motor drive unit or the motor. If motor drive unit 8 for channel A is detected to be faulty, for example when motor M1 is in operation, the SEM 3 will, via output 36, open SSR's 12 and 14, 16–32 and close SSR's 13 and 15, 17–33, thus switching to channel B. If the SEM 3 senses a fault in the motor drive unit 9 of channel B, then it will turn off the drive of motor drive unit 9 and close SSR 11, reverting to emergency fixed frequency and voltage power. Likewise, a failure of supply in this situation allows SSR 10 to be closed and SSR 11 opened as an alternative emergency power path.

Thus the system is a fully automatic redundant system, which by multiplexing the output of a variable frequency, variable voltage electronic motor drive unit, reduces the overall complexity of the system The overall effect is to achieve high reliability, making the configuration ideal for the subsea, production fluid extraction environment where replacement costs, in the event of a failure, are prohibitive, and loss of production is unacceptable.

What is claimed is:

1. Apparatus for use in controlling the operation of a hydrocarbon production well, comprising:

supply means for providing an electric power supply a plurality of electrically operated actuating devices;

a first drive means responsive to said power supply for providing a drive signal for said actuating devices;

control means for multiplexing said drive signal and applying said multiplexed drive signal to said actuating devices;

a second drive means, the control means being adapted to select whether to apply the drive signal of the second drive means to said actuating devices in a multiplexed manner or the drive signal from the first drive means to said actuating devices in a multiplexed manner; and wherein said control means causes the drive signal of the non-selected drive means of the first and second drive means instead of that of the selected drive means of the first and second drive means to be applied to said actuating devices in a multiplexed manner in the event of a fault.

2. Apparatus according to claim 1, wherein said supply means comprises an umbilical electric cable.

3. Apparatus according to claim 1, wherein said power supply is AC.

4. Apparatus according to claim 3, wherein said power supply is 3-phase AC.

5. Apparatus according to claim 1, wherein said actuating devices are electric motors.

6. Apparatus according to claim 1, wherein said control means includes means for monitoring said power supply.

7. Apparatus according to claim 1, wherein said control means monitors at least the first drive means.

8. Apparatus according to claim 1, where in the apparatus is located at a well tree of a hydrocarbon production well.

* * * * *